United States Patent [19]

Kmetz

[11] 4,095,555

[45] Jun. 20, 1978

[54] PAINTING DEVICE FOR FLAGPOLES

[76] Inventor: John Kmetz, 125 W. Third St., Clifton, N.J. 07011

[21] Appl. No.: 717,549

[22] Filed: Aug. 25, 1976

[51] Int. Cl.[2] ..... B05C 1/02

[52] U.S. Cl. ..... 118/208

[58] Field of Search ..... 118/108, 208, 307, 267; 15/104.04, 104.92; 401/196, 201

[56] References Cited

U.S. PATENT DOCUMENTS

| | | | |
|---|---|---|---|
| 615,627 | 12/1898 | Meinecke | 118/208 |
| 2,429,915 | 10/1947 | Bell | 118/208 X |
| 2,809,385 | 10/1957 | Griffeth et al. | 401/196 X |
| 2,858,555 | 11/1958 | Medovick | 118/208 X |
| 3,726,602 | 4/1973 | Rosocha | 401/196 |

*Primary Examiner*—John P. McIntosh

*Attorney, Agent, or Firm*—Mel K. Silverman; David A. Jackson; Richard M. Goldberg

[57] ABSTRACT

A device particularly adapted for the painting of flagpoles including a sponge brush circumferentially disposed about a flagpole to be painted; elevation means for the selectable advancement of said sponge brush up and down the pole to be painted; and paint containing means abuttingly disposed to said sponge brush, said container means serving to hold a supply of paint, said container means including a multiplicity of holes through which the paint may flow into said sponge brush; and tension means whereby the pressure of said sponge brush against the pole may be selectably controlled.

2 Claims, 5 Drawing Figures

FIG I

PAINTING DEVICE FOR FLAGPOLES

BACKGROUND OF THE INVENTION

The present invention pertains to means for painting flagpoles.

As is apparent, the painting of a flagpole has always presented a problem to maintenance personnel. Reultingly, many flagpoles are often never painted after their initial installation. Hence, the prevalance of rusty and other such improperly kept flagpoles.

Solutions to this problem have been few and far between and, more particularly, appear in only one U.S. Patent which is known to the Applicant. This patent is U.S. Pat. No. 615,627 (1898) to Meinecke entitled "Pole Painter".

The above patent discloses a means for painting a flagpole is which paint is supplied to the brushes from a pair of reservoirs through a series of tubes. In addition to the high expense of manufacture, this approach to the problem of flagpole painting is cumbersome and, therefore, has not resulted in general acceptance of the approach of Meinecke to the problem of flagpole painting.

Thusly, the need has existed for an improvement in the area of apparatuses for the painting of flagpoles.

Accordingly, the present invention provides a simple and inexpensive device with which a pole of any height can be painted while operated solely from the ground.

SUMMARY OF THE INVENTION

The present invention involves the use of a simple halyard, usually secured to the pole for raising and lowering of the present device. The present invention provides a means for adapting to the varying diameter of the pole and particularly adapted for the painting of flagpoles. The invention includes a sponge brush circumferentially disposed about a flagpole to be painted; elevation means for the selectable advancement of said sponge brush up and down the pole to be painted; and paint containing means abuttingly disposed to said sponge brush, said container means serving to hold a supply of paint, said container means including a multiplicity of holes through which the paint may flow into said sponge brush; and tension means whereby the pressure of said sponge brush against the pole may be selectably controlled.

It is an object of the present invention to provide a simple means adapted for the easy painting of a flagpole.

It is a further object of the present invention to provide a device for the painting of a flagpole which is simple in manufacture and economical in construction.

DETAILED DESCRIPTION OF THE INVENTION

Figure 1:
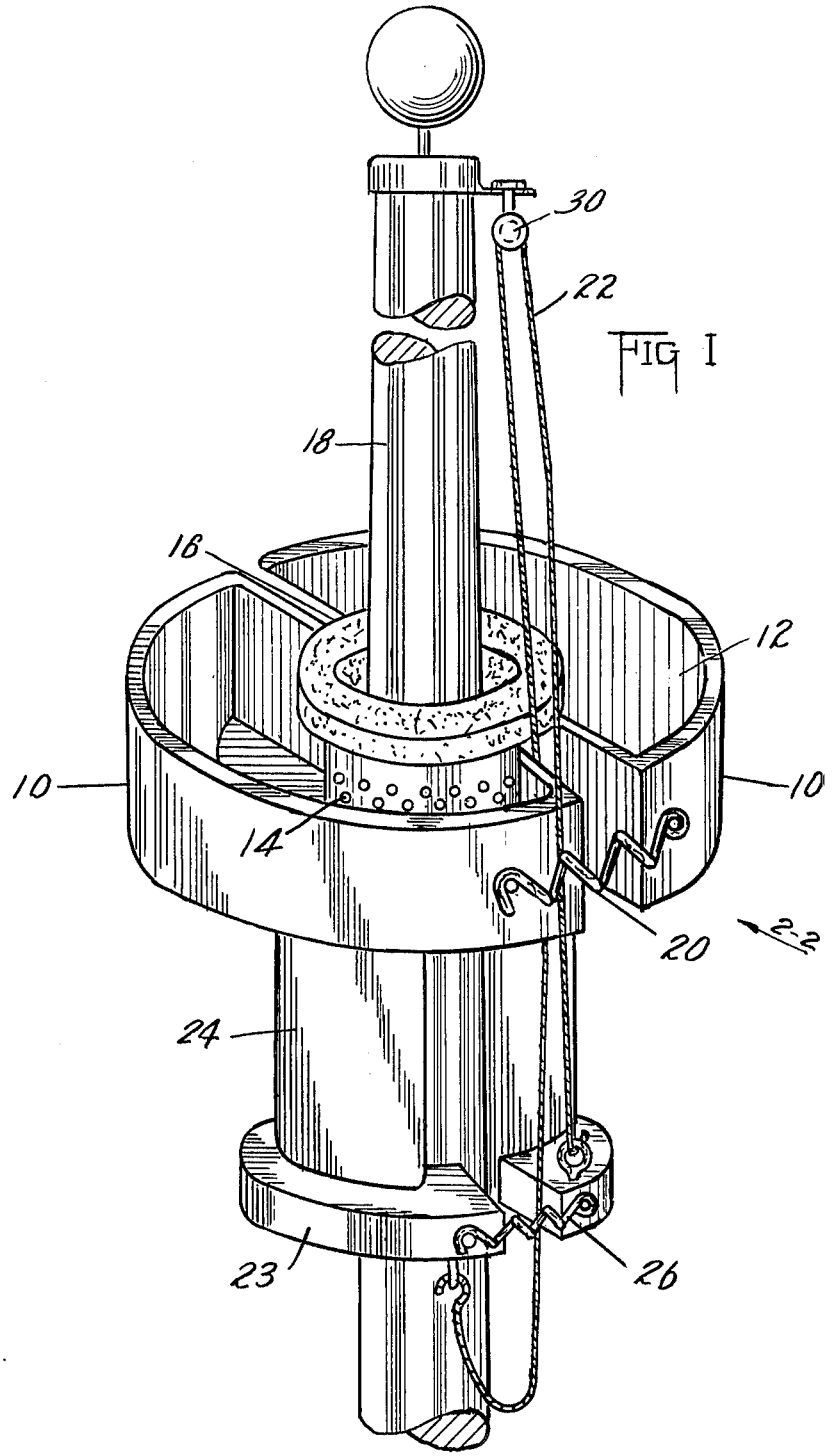
FIG. 1 is a perspective view of the present invention shown in association with a flagpole to be painted.

With reference to FIG. 1, it is noted that the present invention includes a reservoir means 10 which includes a plurality of paint-holding troughs 12 and a multiplicity of flow holes 14. The reservoir means is circumferentially disposed about a sponge or osmotic brush 16 which is itself circumferentially disposed about a flagpole 18.

An appropriate pressure of the holes 14 against the sponge brush 16 and, concurrently, of the sponge brush 16 against the pole 18 is assured by virtue of a biasing means 20 which provides the two halves of the reservoir 10 with appropriate inner-directed pressure. It is to be appreciated that as the reservoir 10 and sponge brush 16 are moved upward upon the pole through the use of the lanyard means 22, the spring means 20 will cause the halves of the reservoir to contract or pull together, thereby insuring a uniformity of pressure against the pole regardless of the change in diameter which occurs with progressive movement of the reservoir up the pole.

Figure 2:
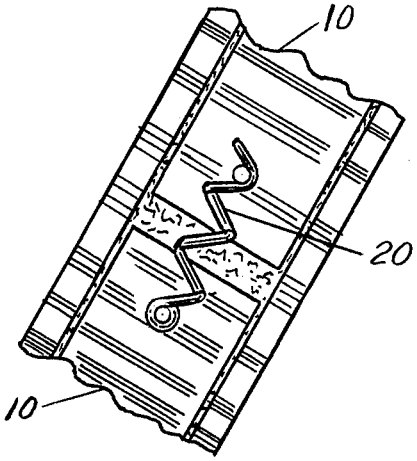
FIG. 2 is a radial plan view of the present invention taken in the direction of the arrow 2—2 of FIG. 1.

Some of the features of the present apparatus are shown in greater detail in the other figures. For example, FIG. 2 shows more fully the biasing means 20.

Figure 3:
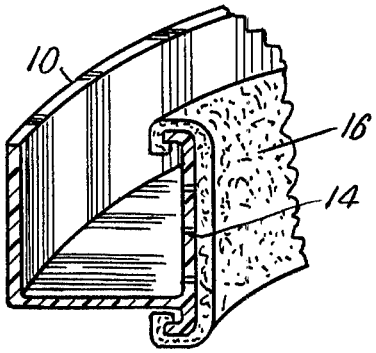
FIG. 3 is a partial radial fragment showing the seep-through osmosis from the reservoir to the sponge brush.
Figure 4:
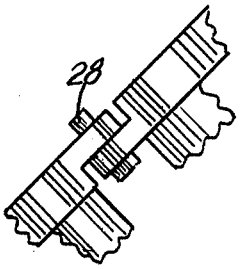
FIG. 4 is a rear perspective fragmentary view taken from the opposite side as that indicated by arrow 2—2 of FIG. 1.

In FIG. 3, there is shown in greater detail the interface between the reservoir means 10 and the sponge brush 16 and, more particularly, the multiplicity of channels 14 through which the paint is permitted to flow to the sponge brush.

It is to be appreciated that the sponge brush 16 may, after several usages, be readily replaced through a simple removal of the spring means 20.

Figure 5:
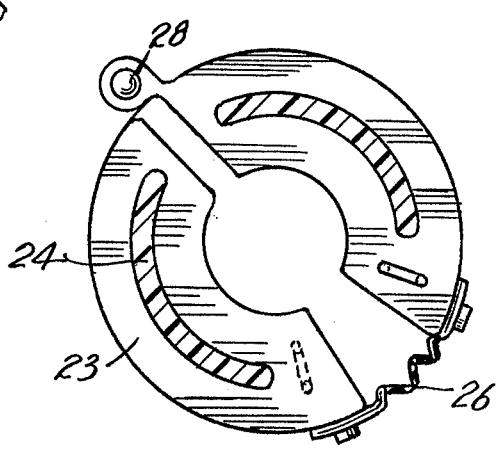
FIG. 5 is a radial cross-sectional view of the paint guide.

With reference to FIG. 5, there is shown in cross-sectional radial view, the lower portion of the present apparatus which also appears, in like reference numerals, in the perspective view of FIG. 1. A lower arcuate flange portion 23 is attached to the central arcuate section 24 of the reservoir means to serve as a support and guide for the upper area of the apparatus. As may be noted, the lower portion 23 is provided with a biasing means 26, similar to said biasing means 20. This is required in order to assure that the lower portion 23 does not in any way interfer with the change in diameter function of the first biasing means 20.

In further regard to FIG. 5, there is noted a pivot pin 28 which serves to maintain the two halves of the lower portion 23 in proper relationship.

The actual elevation (or delevation) of the pole painter is achieved through the use of the lanyard 22 and its associated pulley 30 by simply pulling the lanyard downward, the apparatus will move upward. Conversely, by releasing the lanyard, the apparatus will move downward.

It is to be noted that as the apparatus moves upward near the pulley 30, the separation between the two halves of the apparatus will permit the flagpole to be painted up to its top end.

Thus, it is seen that the objects set forth in the Summary of the Invention are efficiently attained by the present apparatus as above described.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention what I claim as new, useful and non-obvious and accordingly secure by Letters Patent of the United States is:

1. An apparatus for painting a pole, comprising:

(a) a sponge adapted to be circumferentially disposed about a flagpole to be painted for painting said pole;

(b) means for containing paint, said means circumferentially and abuttingly disposed about said sponge, said means comprising at least two segmental sections, said sections defining at least one space therebetween, each section including a multiplicity of holes in abuttment to said sponge through which paint may osmotically flow to said sponge;

(c) spring tension means adapted for maintaining an appropriate pressure on said sponge against said pole, said tension means being further adapted to maintain a constant pressure against the pole regardless of changes in diameter which occur at different heights of the pole;

(d) means for supporting and guiding said paint-containing means, said supporting and guiding means circumferentially and abuttingly disposed about said pole below said means for containing paint, said supporting and guiding means comprising at least two segmental sections, said sections defining at least one space therebetween, at least one space of said supporting and guiding means being in substantial alignment with at least one space of said paint containing means;

(e) second spring tension means adapted for maintaining an appropriate pressure of said supporting and guiding means against said pole, said second tension means being further adapted to maintain a constant pressure against the pole regardless of changes in diameter which occur at different heights of the pole and regardless of the texture or configuration of the surface of the pole; and (f) lanyard means connected to one section of said supporting and guiding means, said lanyard means passing through one space of said supporting and guiding means and one space of said paint containing means, said lanyard means enabling the selectable elevation and de-elevation of the present apparatus regardless of the configuration or texture of the pole.

2. The apparatus of claim 1 wherein said supporting and guiding means comprises a central arcuate section and an arcuate flange section attached to the lower end of said central arcuate section, said lanyard means being attached to said arcuate flange section.

* * * * *